US006676451B2

(12) United States Patent
Suzuki et al.

(10) Patent No.: US 6,676,451 B2
(45) Date of Patent: Jan. 13, 2004

(54) CONNECTIVE JACK

(75) Inventors: Hiroshi Suzuki, Tokyo (JP); Fumio Nozaki, Kitaibaraki (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 09/982,605

(22) Filed: Oct. 18, 2001

(65) Prior Publication Data

US 2002/0052149 A1 May 2, 2002

(30) Foreign Application Priority Data

Oct. 30, 2000 (JP) ..... 2000-330447

(51) Int. Cl.[7] ..... H01R 24/04
(52) U.S. Cl. ..... 439/668; 439/669
(58) Field of Search ..... 439/608, 609, 439/668, 669

(56) References Cited

U.S. PATENT DOCUMENTS 5,147,221 A * 9/1992 Cull et al. ..... 439/668
5,547,400 A * 8/1996 Wright ..... 439/668
6,296,525 B1 * 10/2001 D'Addario et al. ..... 439/668

FOREIGN PATENT DOCUMENTS

JP 517968 3/1993

* cited by examiner

*Primary Examiner*—Tho D. Ta
(74) *Attorney, Agent, or Firm*—Darby & Darby

(57) ABSTRACT

A sleeve terminal includes elastic spring pieces cantilevered inside a housing about a plug insertion hole. The sleeve terminal elastically urges an electrode, on a plug inserted in the plug insertion hole, into stable electrical connection with a circuit. A plate portion of the sleeve terminal includes a first contact projection. A second and third contact projection are on each spring piece. During insertion, the spring pieces elastically urge the electrode into contact with each contact projection, eliminating a separate sleeve piece, and provide stable elastic electrical connection to the plug.

18 Claims, 5 Drawing Sheets

CONNECTIVE JACK

BACKGROUND OF THE INVENTION

1. Field of the Invention

The present invention relates to a connective jack that provides secure electrical connection between a plug and a circuit. More specifically, the present invention relates to a connective jack equipped with a sleeve terminal that forms an elastic electrical connection with a sleeve electrode on a plug.

2. Description of the Related Art

Referring to FIGS. 7 and 8, a sleeve terminal 102 is formed by bending an elastic metal sheet to form a "C-shaped" cross section. Sleeve terminal 102 includes a spring piece 104 cantilevered integrally from one edge of a horizontal plate 102*a*. A contact piece 107 extends from sleeve terminal 102 and spring piece 104.

A conventional jack 100 includes a jack housing 101, plug insertion hole 103, a window hole 105, and a cylindrical sleeve 101*a*. Conventional jack 100 is formed to receive a plug (not shown) containing a sleeve electrode 201.

During assembly, sleeve terminal 102 is inserted into window hole 105 of jack housing 101 and attached to jack housing 101. In this attached state, a free end of spring piece 104 projects into plug insertion hole 103 and forms elastic electrical contact with a flat side of sleeve electrode 201.

It is to be understood, that contact with sleeve electrode 201 is achieved by having spring piece 104 extend into plug insertion hole 103, as shown.

It is to be further understood, that sleeve electrode 201 of the plug (not shown) serves as a ground electrode for the plug. By having sleeve electrode 201 insulated from and formed co-axially around a chip electrode 202 and a ring electrode 203, impedance matching with a cable (not shown) can be provided and transmission properties for high-frequency signals flowing through chip electrode 202 and ring electrode 203 can be improved.

It is to be understood as desirable to provide impedance matching for conventional jack 100, and that to achieve this it is desirable to have sleeve terminal 102 connecting to sleeve electrode 201 formed as a cylindrical ground terminal surrounding the plug.

Since cylindrical metal sleeve piece 106 is produced separately through cutting or stamping and is attached in cylindrical sleeve 101*a* of jack housing 101, impedance matching can be difficult, and costs and assembly time increased.

Sleeve piece 106 is attached in cylindrical sleeve 101*a* and forms an electrical contact with sleeve terminal 102 by pressing against contact piece 107 formed integrally with sleeve terminal 102. When the plug (not shown) is inserted into jack 100, metal sleeve piece 106 acts as a ground terminal surrounding sleeve electrode 201.

In conventional jack 100, described above, metal sleeve piece 106 must be produced separately from the sleeve terminal 102. This separate production increases the total number of parts, requires a more complex structure to connect to sleeve terminal 102, there by raising production costs for jack 100 and increases the risks for impedance mismatching.

It is possible to extend a leg from metal sleeve piece 106 and connect to a ground pattern (not shown), making metal sleeve piece 106 itself serve as sleeve terminal 102.

However, it is to be understood, that since sleeve piece 106 is cylindrical, it cannot provide an elastic contact with sleeve electrode 201. This inelasticity may lead to a bad contact between sleeve terminal 102 and the plug (not shown) and is an undesirable quality.

Elastic contact with sleeve electrode 201 is achievable using spring piece 104 of sleeve terminal 102 in jack 100. However, it is to be understood that since there is only one elastic contact position, the reliability of the electrical contact is inadequate for consumer needs.

OBJECTS AND SUMMARY OF THE INVENTION

It is an object of the present invention to provide a jack that improves reliably and contact security while reducing the number of parts, costs, and assembly time.

It is another object of the present invention to provide bounding elastic contact with a sleeve electrode of a plug.

It is another object of the present invention to provide a connective jack that minimizes the negative connective effects of dust and dirt in a connector by employing repetitive three-point elastic connection with a plug.

It is another object of the present invention to provide a connective jack with easy snap-in assembly for a sleeve terminal, a chip terminal, and a ring terminal, thereby shortening assembly time and reducing costs.

It is another object of the present invention to overcome the problems described above and to provide a jack wherein a sleeve electrode is securely and electrically covered without requiring a separate cylindrical metal sleeve piece Briefly stated, the present invention relates to a connective jack including a sleeve terminal having elastic spring pieces cantilevered inside a housing about a plug insertion hole. The sleeve terminal elastically urges an electrode, on a plug inserted in the plug insertion hole, into stable electrical connection with a circuit. A plate portion of the sleeve terminal includes a first contact projection. A second and third contact projection are on each spring piece. During insertion, the spring pieces elastically urge the electrode into contact with each contact projection, eliminating a separate sleeve piece, and provide stable elastic electrical connection to the plug.

According to an embodiment of the present invention, there is provided: a connective jack assembly, comprising: means for receiving a plug in a plug insertion hole, means for connecting the plug to a circuit when the plug is inserted, the means for connecting includes means for permitting a three-point electrical connection to an outer surface of an electrode on the external plug, the means for permitting having a shape which elastically urges the outer surface into the three-point electrical connection, and at least one of the means for receiving and the means for permitting having a shape which urges the means for permitting into an elastic snap-fit engagement with the means for receiving and enables the means for permitting to resist movement relative to the means for receiving when the plug is inserted, whereby stable electrical connection between the electrode and the circuit is assured.

According to an embodiment of the present invention, there is provided: a connective jack assembly, further comprising: a first and a second spring member on the means for permitting, the means for receiving being a housing, the spring members cantilevered inside the housing during the elastic snap-fit engagement, and the spring members extending substantially adjacent the outer surface and coaxial the plug insertion hole for the urging of the outer surface into the three-point electrical connection.

According to an embodiment of the present invention, there is provided: a connective jack assembly, further comprising: a horizontal plate on the means for permitting, the means for permitting being a sleeve terminal, a position groove on the housing, and the position groove engaging opposite sides of the horizontal plate after the snap-fit engagement and laterally supporting the sleeve terminal relative the plug insertion hole whereby the stable electrical connection is maintained during operation.

According to an embodiment of the present invention, there is provided: a connective jack assembly, further comprising: a first contact projection on the horizontal plate, a second contact projection on the first spring member, a third contact projection on the second spring member, and the first, the second, and the third contact projections projecting substantially radially inward to the plug insertion hole and permitting the three-point electrical connection to the outer surface of the electrode.

According to an embodiment of the present invention, there is provided: a connective jack assembly, further comprising: a first and a second engagement projection on the housing, the first and the second engagement projections each having a sloped surface and a second surface, a first and a second side plate on the sleeve terminal orthogonal the horizontal plate and positionable adjacent the housing, a first notch on each the first and the second side plate, and the slope surfaces engaging and urging open each the first and the second side plate when the sleeve terminal is pressed onto the housing and each the second surface providing the snap-fit engagement to each respective the first notch, whereby the sleeve terminal is secured to the housing.

According to an embodiment of the present invention, there is provided: a connective jack assembly, further comprising: a chip terminal in the means for connecting, a chip terminal holding groove in the housing, the chip terminal in the chip terminal holding groove, at least a first engagement portion of the chip terminal in restrictive contact with the chip terminal holding groove and retaining the chip terminal in the housing, a chip leg member extending from the chip terminal engageable with the circuit, and a chip contact member on the chip terminal having a shape enabling secure elastic electrical connection from a chip electrode portion on the plug to the circuit.

According to an embodiment of the present invention, there is provided: a connective jack assembly, further comprising: a ring terminal in the means for connecting, a ring terminal holding groove in the housing, an engagement piece on a base portion of the ring terminal, a slip prevention hole on the housing engagable with the engagement piece during an insertion of the ring terminal in the ring terminal holding groove, a ring leg member extending from the ring terminal engagable with the circuit, and a ring contact member on the ring terminal having a shape enabling secure elastic electrical connection from a ring electrode portion of the plug to the circuit.

According to another embodiment of the present invention there is provided a connective jack assembly, comprising: a housing member, the housing member including a plug hole for receiving a plug, a sleeve terminal on the housing member alignable with a circuit, a first and a second spring piece on the sleeve terminal extendable inside the housing member and coaxial the plug hole for elastically engaging the plug, a first projection on a plate portion of the sleeve terminal, a second projection on the first spring piece opposite the first projection, a third projection the second spring piece opposite the first projection, and the first and the second spring pieces urging a sleeve electrode on the plug into firm contact with the first, the second, and the third projection when the plug is inserted, whereby the plug is urged into stable three-point connection with the sleeve terminal and the circuit.

According to an embodiment of the present invention, there is provided: a connective jack assembly, further comprising: a horizontal plate on the sleeve terminal, a position groove on the housing member opposite the plug hole, the horizontal plate in the position groove, and the position groove engaging opposite sides of the horizontal plate during an assembly of the first and the second spring piece in the housing member, whereby the position groove laterally supports the sleeve terminal and resists a movement of the sleeve terminal relative to the housing member during the insertion.

According to an embodiment of the present invention, there is provided: a connective jack assembly, wherein: the position groove includes a window hole, and the first and the second spring piece insertable into the housing member through the window hole during the assembly.

According to an embodiment of the present invention, there is provided: a connective jack assembly, wherein: at least one of the housing member and the sleeve terminal have a shape which urges the sleeve terminal into a elastic-engagement with the housing member during the assembly whereby the sleeve terminal resists movement of the sleeve terminal relative to the housing member during the insertion of the plug.

According to an embodiment of the present invention, there is provided: a connective jack assembly, further comprising: a first and a second engagement projection on the housing member, a first and a second side plate on the sleeve terminal opposite the horizontal plate, a notch on each the first and the second side plate positionable opposite the first and the second engagement projection, and the notches engaging a sloped surface on each the first and the second engagement projection during an assembly of the connective jack and engaging a flat surface upon completing the assembly whereby the snapping-engagement fixes the sleeve terminal to the housing member and resists the movement.

According to an embodiment of the present invention, there is provided: a connective jack assembly, further comprising: a chip terminal, a chip terminal holding groove in the housing member, the chip terminal in the chip terminal holding groove, at least a first engagement claw on the chip terminal in restrictive contact with the chip terminal holding groove, whereby the chip terminal is retained in the housing member, a chip leg member extending from the chip terminal engagable with the circuit, and a chip contact member on the chip terminal having a shape enabling secure elastic connection to a chip electrode of the plug during the insertion, whereby the chip contact member is urged into stable electrical connection with the chip electrode.

According to an embodiment of the present invention, there is provided: a connective jack assembly, further comprising: a ring terminal, a ring terminal holding groove in the housing member, the ring terminal in the ring terminal holding groove, an engagement piece on a base portion of the ring terminal, the housing member including a slip prevention hole formed for receiving and retaining the engagement piece during an insertion of the ring terminal into the ring terminal holding groove, a ring leg member extending from the ring terminal engagable with the circuit, and a ring contact on the ring terminal having a shape enabling secure elastic connection to a ring electrode of the plug during the insertion, whereby the ring contact is urged into stable electrical connection with the ring electrode.

According to another embodiment of the present invention there is provided a connective jack, comprising: an insulative housing having a plug insertion hole for receiving a plug during an insertion of the plug, a sleeve terminal on the insulative housing having a shape enabling secure elastic electrical connection to a circuit, a first and a second spring piece on the sleeve terminal extending inside the insulative housing coaxial the insertion hole, the insulative housing having a window hole for receiving the first and the second spring piece during an assembly of the connective jack, and the first and the second spring piece having a shape resiliently urging the plug into stable close contact with the sleeve terminal during the insertion whereby the sleeve terminal enables secure electrical connection from the plug to the circuit.

According to an embodiment of the present invention, there is provided: a connective jack assembly, further comprising: a first, a second, and a third contact projection, the first and the second contact projection on respective the first and the second spring piece, an attachment plate on the sleeve terminal, the third contact projection on the attachment plate opposite the first and the second contact projection, and the first and the second spring piece elastically urging the plug into three-point contact with the first, the second, and the third contact projection.

According to an embodiment of the present invention, there is provided: a connective jack assembly, further comprising: a first and a second side plate on the sleeve terminal opposite the attachment plate, a first and a second notch on respective the first and second side plate, a first and second projection on the insulative housing opposite each respective the first and the second notch, and at least one of the first and the second notch and the first and the second projection having a shape which provides the sleeve terminal with a snapping-engagement to the insulative housing during an assembly of the connective jack.

According to another embodiment of the present invention there is provided a sleeve terminal for a connective jack, comprising: a metallic side, a first contact on the metallic side, first and second spring pieces depending from the metallic side, third and forth contacts at extremities of the first and second spring pieces, the first and second spring pieces placing urgent inward force on a plug inserted into the connective jack to resiliently capture the plug in three-point resilient contact between the first, second, and third contacts.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 6 (B) is a plan drawing of a sleeve terminal.

FIG. 6 (C) is a side-view drawing of a sleeve terminal.

DETAILED DESCRIPTION OF THE PREFERRED EMBODIMENTS

Figure 1:
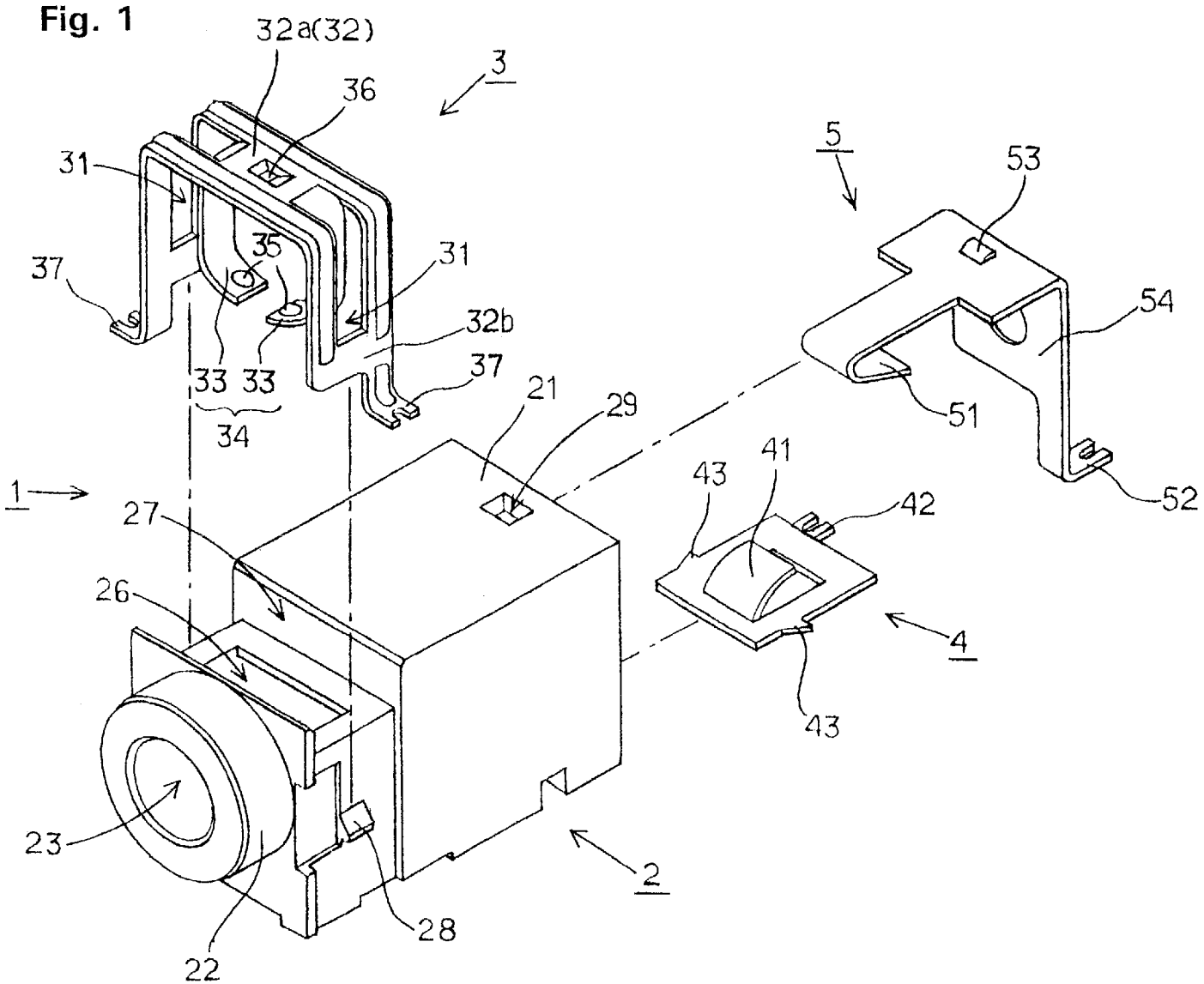
FIG. 1 is an exploded perspective view according to an embodiment of the present invention.

Referring to FIG. 1, a jack 1 includes a jack housing 2 and a sleeve terminal 3 retained on jack housing 2. A chip terminal 4 and a ring terminal 5 are inserted into a rear side of jack housing 2.

It is to be understood that chip terminal 4, ring terminal 5, and sleeve terminal 3 are joined to jack housing 2 while remaining mutually insulated from each other.

Jack housing 2 is formed from a main housing unit 21 and a cylindrical sleeve 22. Main housing unit 21 is formed roughly in the shape of a box from an insulative synthetic resin such as PBT or nylon. Cylindrical sleeve 22 is projected integrally from a front side of main housing unit 21.

A plug insertion hole 23 is formed from the front side to the back side of jack housing 2 to allow insertion of a plug 200 (shown and described later). During insertion, plug 200 is passed through main housing unit 21 and cylindrical sleeve 22.

A position holding groove 27 is formed continuously on the front and side surfaces of main housing unit 21. Sleeve terminal 3 has a "C"-shaped cross section. Sleeve terminal 3 is positioned by positioning groove 27 along an outer perimeter surface of main housing unit 21 to the rear side of cylindrical sleeve 22.

A window hole 26 is formed continuously with plug insertion hole 23 on a surface of main housing unit 21 adjacent position groove 27.

A pair of engagement projections 28, 28 are formed on side surfaces of jack housing 2. Engagement projections 28, 28 are formed to engage a corresponding pair of notches 31 on sleeve terminal 3, as will be explained. Engagement projections 28, 28 and prevent slippage of sleeve terminal 3 after assembly, as will be described. A slip-prevention hole 29 is formed in a top side of main housing unit 21.

Sleeve terminal 3 is formed from a conductive sheet material and is bent into shape. Sleeve terminal 3 integrally includes an attachment plate 32 and a pair of curved spring pieces 33, 33. Attachment plate 32 is formed with a "C"-shaped cross section from a horizontal plate 32*a* and a pair of side plates 32*b* disposed perpendicular to horizontal plate 32*a*. Curved spring pieces 33, 33 are cantilevered from horizontal plate 32*a* during the forming process.

Curved spring pieces 33, 33 are formed by cutting away sections of side plates 32*b* in a "C" shape and bending spring pieces 33, 33 inward with horizontal plate 32*a* as a base. Curved plate springs 33, 33 are each bent to form an arcuate cross section and comprise a cylindrical sleeve contact cylinder 34.

An inner diameter of contact cylinder 34 is to be understood as sufficiently smaller than an outer diameter of a sleeve electrode 201 (shown later) of plug 200 so that contact cylinder 34 can cover and support an outer perimeter surface of sleeve electrode 201, as will be described.

A pair of movable contact projections 35, 35 are formed toward the free ends of curved spring pieces 33, 33. Contact projections 35, 35 are stamped inward toward a center axis of the sleeve contact cylinder 34.

A fixed contact projection 36 is formed at the center of horizontal plate 32*a* and is stamped downward toward a center axis of sleeve contact cylinder 34.

Notches 31, 31 of side plates 32*b*, are formed during formation of curved spring pieces 33, 33. Notches 31,31 serve as engagement holes for respective engagement projections 28 to secure sleeve terminal 3 to jack housing 2. A pair of sleeve legs 37, 37 are the lower ends of side plates 32*b*, 32*b* bent horizontally at right angles to be parallel to a bottom surface of main housing unit 21.

Sleeve legs 37, 37 are at diagonal corners of sleeve terminal 3. As a result, identically shaped jacks 1 may be mounted on a printed circuit substrate (not shown) at a narrow pitch without having sleeve terminals 3 obstruct each other. It is to be understood that the position of sleeve legs 37, 37 provides a commercial benefit to the invention.

Chip terminal 4 is formed from a conductive sheet. A center of chip terminal 4 is cut away to form an upwardly sloping piece. A chip contact 41 is formed at the end of the upwardly sloping piece. Chip leg 42 is formed at a rear of chip terminal 4. Chip leg 42 is parallel to the bottom surface of main housing unit 21. A pair of engagement claws 43,43 extend from chip terminal 4 to engage jack housing 2 upon insertion, as will be explained.

Ring terminal 5 is also formed from a conductive sheet. Ring terminal 5 includes a base 54 having a perpendicular "L" shape. A ring contact 51 is continuously formed from base 54 and bends downward and back in a "U" shape. A ring leg 52 horizontally extends from base 54 and is parallel with the bottom surface of main housing unit 21. An engagement piece 53 extends upward from a top surface of base 51 to engage slip-prevention hole 29 of main housing unit 21, as will be explained.

It is to be understood that jack 1 may be equipped with a switching circuit (not shown) that switches according to an insertion and removal action. Where jack 1 includes such a switching circuit, multiple contact terminals having similar structures may be attached to main housing unit 21 based on the number of switching circuits.

During assembly of jack 1, sleeve terminal 3, chip terminal 4, and ring terminal 5 are inserted or 'snapped' onto or into jack housing 2. It is to be understood that the attachment operations can be performed in any order sufficient to assemble jack 1. The reliable connections provided by these members serve to minimize assembly time and promote automation.

During assembly with sleeve terminal 3, sleeve contact cylinder 34 is inserted through window hole 26 of main housing unit 21 and side plates 32*b* of attachment plate 32 slide into positioning groove 27. Side plates 32*b* pass over engagement projections 28, 28 on the side surfaces of main housing unit 21. Engagement projections 28,28 have a sloping guide surface which guides notches 31, 31.

After notches 31, 31 slip over engagement projections 28, 28 side plates 32*b* snap over engagement projections 28, 28 and prevent attachment plate 32 from being easily removed. Additionally, a front/back movement of sleeve terminal 3 is restricted by positioning groove 27 engaging each edge of sleeve terminal 3.

It is to be understood, that due to the interaction of engagement projections 28, positioning groove 27 and the shape of sleeve terminal 3, sleeve terminal 3 is securely attached to jack housing 2 and resists relative movement during insertion of plug 200, as will be explained.

Also during assembly, chip terminal 4 and ring terminal 5 are inserted into main housing unit 2 from the rear side.

Figure 2:
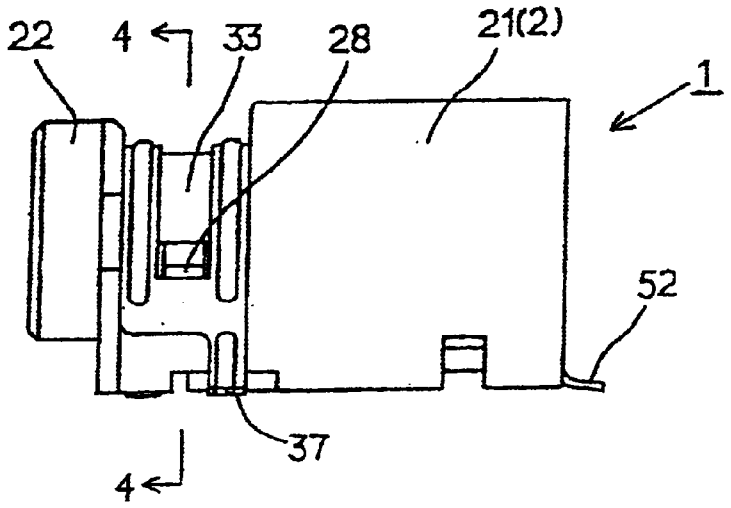
FIG. 2 is a side-view drawing.
Figure 3:
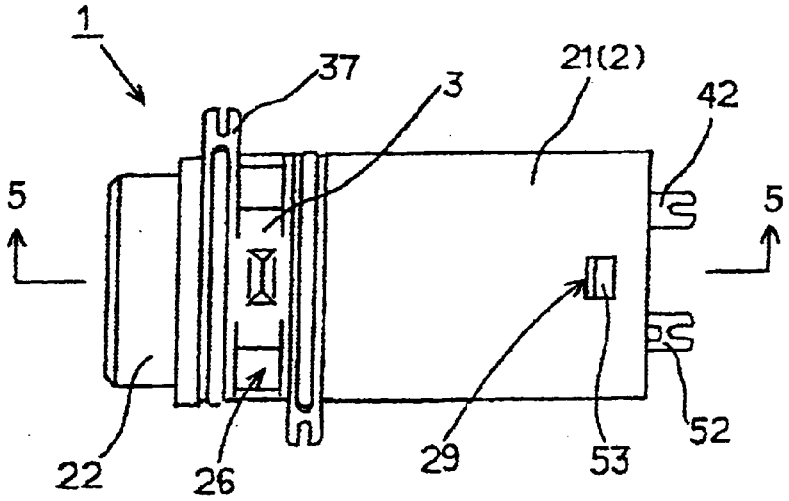
FIG. 3 is a plan-view drawing.

Additionally referring now to FIGS. 2 and 3, spring pieces 33 are within position groove 27 and notches 31, 31 are snap-engaged with respective engagement projections 28. Chip leg 42 and ring leg 52 project from the rear side of jack housing 2 along the bottom surface of jack housing 42 to enable electrical connection. Sleeve legs 37, 37 project away from jack housing 2 to enable electrical connection.

Figure 4:
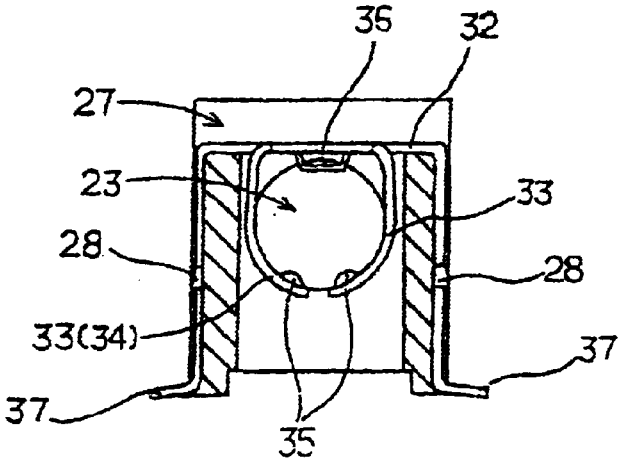
FIG. 4 is a cross-section drawing along the 4—4 line of FIG. 2.

Additionally referring now to FIG. 4, sleeve terminal 3 is fully inserted in position groove 27. Spring pieces 33 form contact cylinder 34 aligned with plug insertion hole 23. It is to be understood, that fixed contact projection 36, and contact projections 35, 35 enable three-position contact with a plug (not shown) inserted through plug insertion hole 23.

Figure 5:
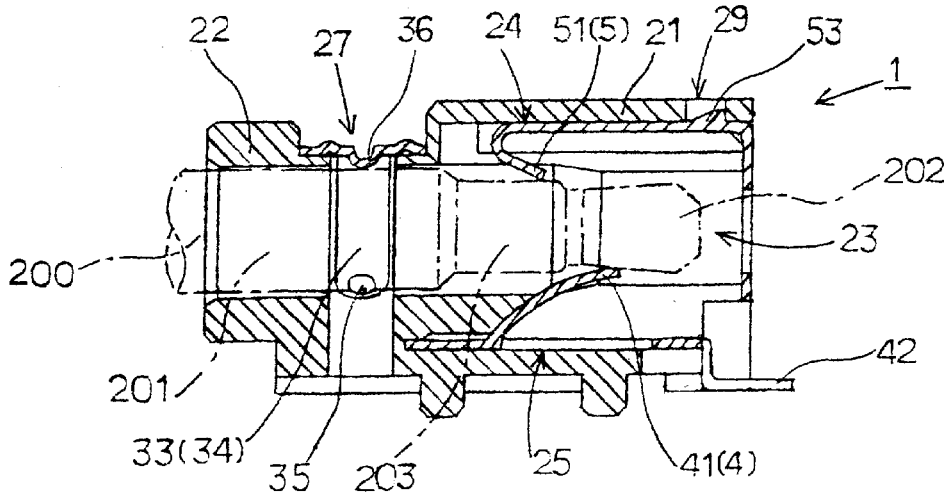
FIG. 5 is a cross-section drawing along the 5—5 line of FIG. 3.
Figure 6A:
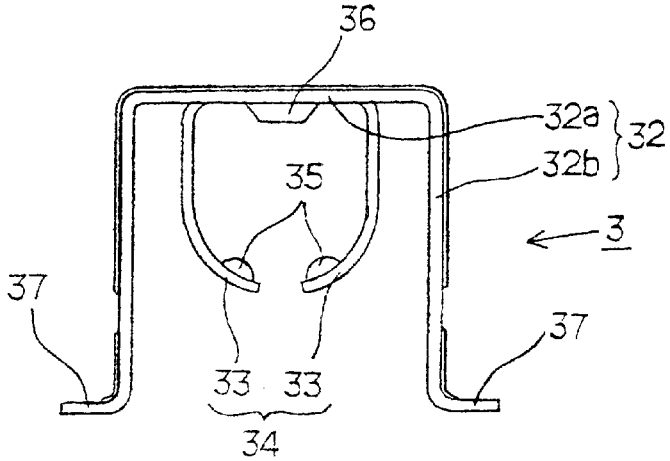
FIG. 6 (A) is a front-view drawing of a sleeve terminal.
Figure 6B:
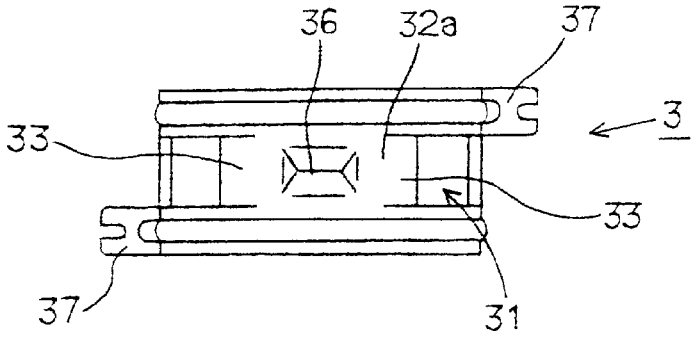
Figure 6C:
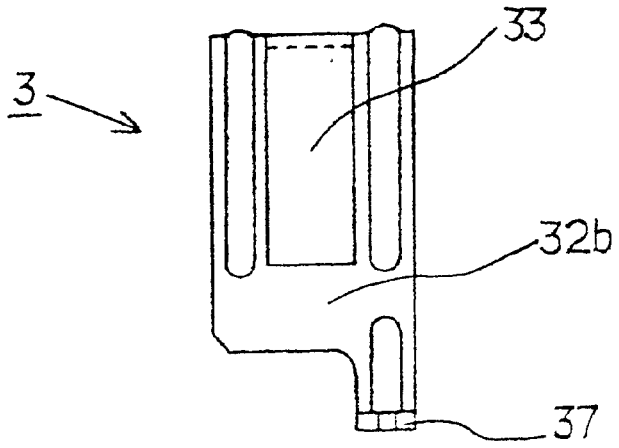
Figure 7:
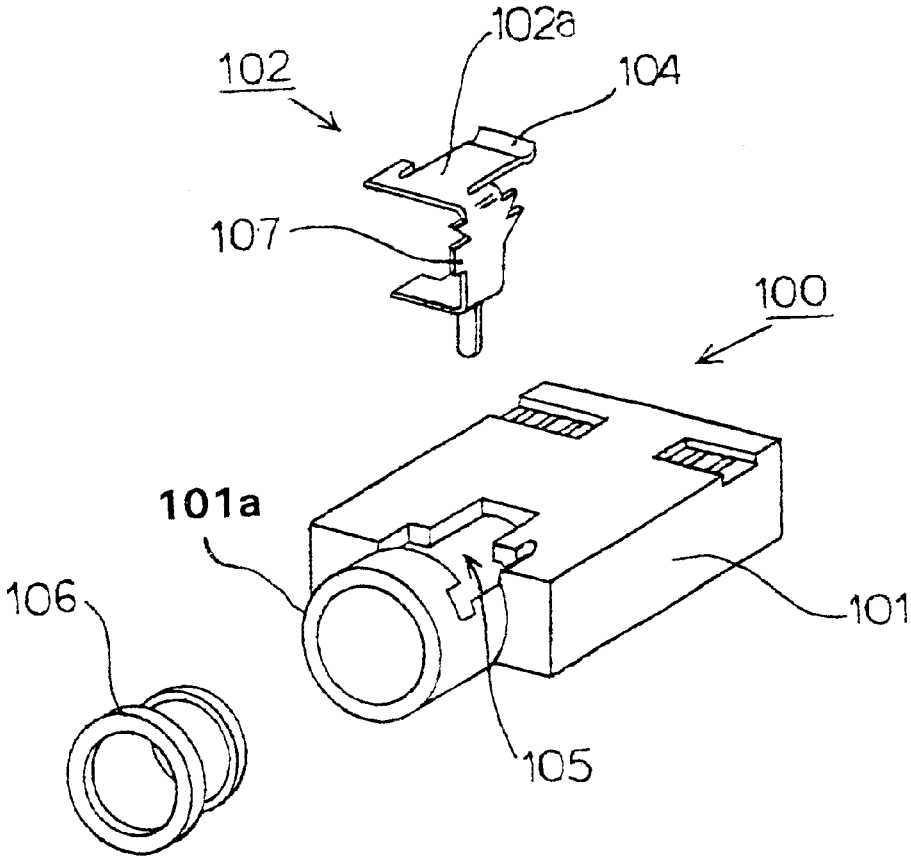
Prior Art Fig. 7
FIG. 7 is an exploded-view of a conventional jack.
Figure 8:
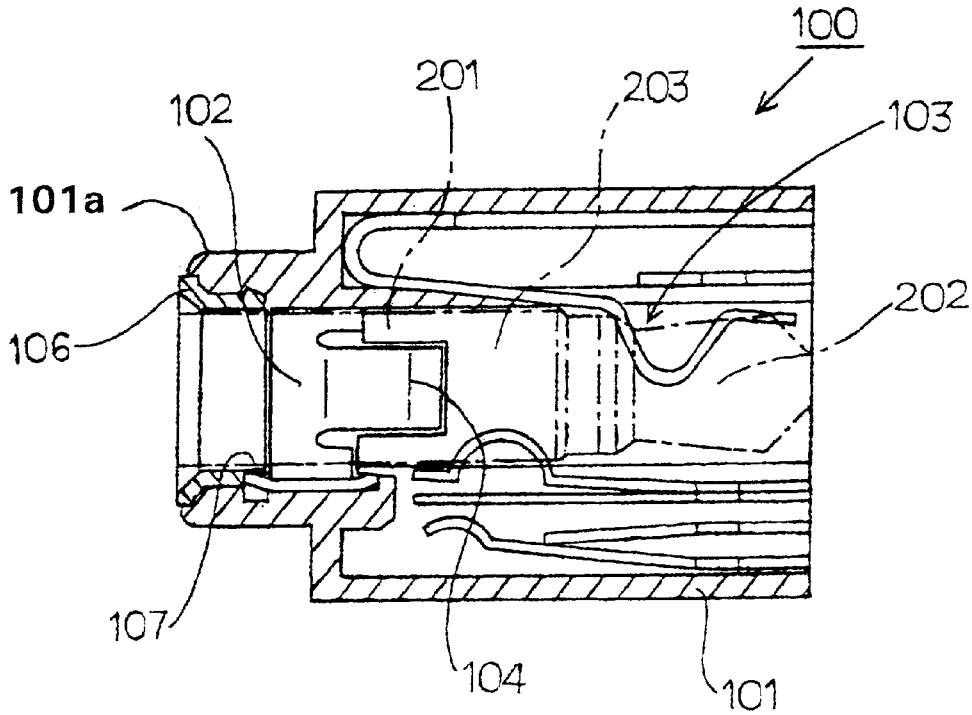
Fig. 8 Prior Art
FIG. 8 is a cross-section drawing of a conventional jack.

Additionally referring now to FIG. 5, plug 200 is inserted in jack 1. A contact holding groove 24 on an upper wall surface of jack housing 2 receives ring terminal 5 during assembly and retains ring terminal 5 in jack housing 2. Engagement piece 53 snaps into slip-prevention hole 29 and securely retains ring terminal 5 in main housing 21.

A contact holding groove 25 on a lower wall surface of jack housing 2, receives and retains chip terminal 4 in jack housing 2.

Since chip terminal 4 engages contact holding grooves 24 chip contact 41 is aligned with plug insertion hole 23, and chip contact 41 can provide secure electrical connection with chip electrode 202 of plug 200. During insertion, chip contact 41 elastically receives chip electrode 202 and returns to a ready position upon removal of plug 200.

It is to be understood, that after insertion, plug 200 extends inward through plug insertion hole 23 and includes, in insertion order, sleeve electrode 201, ring electrode 203, and chip electrode 202.

Since sleeve terminal 3 includes attachment plate 32 and sleeve contact cylinder 34 extends into the plus insertion hole 23, sleeve terminal 3 provides secure electrical connection to sleeve electrode 201 after insertion. It is to be understood, that the center axis of sleeve contact cylinder 34 is positioned in rough alignment with the center axis of plug insertion hole 23 to accurately receive plug 200.

Since chip terminal 4 engages contact holding grooves 24 chip contact 41 of is aligned with plug insertion hole 23, and chip contact 41 can provide secure electrical connection with chip electrode 202 of plug 200. During insertion, chip contact 41 elastically receives chip electrode 202 and returns to a ready position upon removal of plug 200.

During assembly ring terminal 5 is pushed into the main housing unit 21 from the back along the contact holding groove 24. Engagement piece 53 engages slip-prevention hole 29 of the main housing unit 21 and secures ring terminal 5 in contact holding groove 24 and prevents slippage during insertion of plug 200.

When ring terminal 5 is secured in main housing unit 21, ring contact 51 is positioned aligned with plug insertion hole 222, and can therefore ensure elastic electrical contact with ring electrode 203 of plug 200.

It is to be understood that after assembly sleeve legs 37, 37, chip leg 42, and ring leg 52 are co-planar with the bottom surface of main housing unit 21. It is to be understood, that due to this 'co-plainer' positioning, sleeve legs 37, 37, chip leg 42 and ring leg 52 provide stability when jack 1 is mounted on a substrate(not shown).

It is to be further understood, that when jack 1 is mounted on a printed circuit substrate, sleeve legs 37, 37 are soldered to a ground pattern, chip leg 42 to a first signal pattern, and ring leg 52 to a second signal pattern.

After complete insertion of plug 200, sleeve electrode 201 forms an elastic electrical contact with sleeve contact cylinder 34, ring electrode 203 forms an elastic electrical contact with ring contact 51, and chip electrode 202 forms an elastic electrical contact with chip contact 41.

Since sleeve legs 37, 37 connects to a ground pattern, sleeve contact cylinder 34 is kept at the ground potential and covers the perimeter of plug 200. It is to be understood, that as a result, sleeve terminal 3 serves as a ground terminal covering the perimeter of sleeve electrode 201.

Sleeve electrode 201 is supported by fixed contact projection 36 and contact projections 35, 35, on spring pieces 33 which are elastically deformable relative to the center of sleeve contact cylinder 34. Thus, even if plug 200 moves during installation or later use, contact projections 35, 35 will compensate and provide three-point contact with sleeve terminal 3. It is to be understood, that three-point contact prevents inadequate and insecure electrical connection and eliminates risk of electrical mis-connection.

In this embodiment, attachment plate 32 is formed with a "C"-shaped cross section to match the box-shape of jack housing 2 and the round shape of sleeve electrode 201 and plug 200. It is to be understood that attachment plate 32 may be adapted to any shape (square, rectangular, triangular) that allows secure attachment to jack housing 2 while providing secure elastic electrical connection with plug 200 having a corresponding shape.

It should be understood that sleeve contact cylinder 34 may surround ring electrode 203 and chip electrode 202 of the plug 200 from a clearance distance as long as no electrical contact is made with chip terminal 4 or ring terminal 5.

With the structure of the present invention, high-frequency signals flowing through chip terminal 4 and ring terminal 5 are prevented from leaking out and external noise is prevented from coming in.

It is to be understood, that since sleeve contact cylinder 34 is not a complete cylinder, a more reliable electrical connection with sleeve electrode 201 is formed with the two spring pieces 33, 33. Since spring pieces 33, 33 grasp sleeve electrode 201 from both sides they provide balancing forces, stability, and secure engagement.

It should be understood that the perimeter of sleeve electrode 3 may be covered and protected without requiring a separate metal cylindrical sleeve piece. Such a covering can be made from resin and would provide an electromagnetic shield from external noise and facilitate impedance matching thus providing a jack having a simple structure with good high-frequency signal transmission properties. Such a covering could be adapted to connect to engagement projections 28 or in any other manner sufficient to secure the covering to main housing unit 21.

It is to be understood, that since sleeve contact cylinder 34 is not a complete cylinder and is formed with two spring pieces 33, 33, a more reliable electrical connection with sleeve electrode 201. Since spring pieces 33, 33 grasp sleeve electrode 201 from both sides they provide balancing force and stable and secure engagement.

Furthermore, since elastic contact with sleeve terminal 3 is formed at three independent points along sleeve terminal 34, each point acts in part to elastically direct sleeve electrode 201 against the other two points. As a result, even where one side of contact cylinder 34 is not immediately aligned, a more reliable contact is provided.

It is to be understood that contact cylinder 34 is formed to tightly surround a outer perimeter surface of sleeve electrode 201 co-axially thus providing guiding support during plug 200 insertion. Furthermore, since a point contact is formed, insulating material such as dust is prevented from entering jack housing 2 through plug insertion hole 23, thus improving the contact.

It is to be understood, that plug 200 in plug insertion hole 23 is supported at three points, fixed contact projection 36, and the pair of contact projections 35,35. Thus, contact cylinder 34 can be reliably joined to sleeve electrode 201.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims.

It should be understood, that spring pieces 33,33 in conjunction with attachment plate 32 provide bounding-contact with sleeve electrode 201 and support sleeve electrode 201 through such bounding-contact.

It should be understood, that sleeve terminal 3, may be formed with strengthening indentations providing additional rigidity and enhanced spring strength upon forming of sleeve terminal 3 and promoting secure attachment to main housing unit 2 upon assembly.

It should be understood, that while the invention includes the requirements for connective jack assembly a particular portion of that invention is the design of sleeve terminal 3.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims. In the claims, means-plus-function clauses are intended to cover the structures described or suggested herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A connective jack assembly, comprising:

means for receiving a plug in a plug insertion hole;

means for connecting said plug to a circuit when said plug is inserted;

said means for connecting includes a three-point electrical contact with an outer surface of an electrode on said plug;

said means for connecting having a shape which elastically urges said outer surface into said three-point electrical connection;

at least one of said means for receiving and said means for connecting having a shape which urges said means for connecting into an elastic snap-fit engagement with said means for receiving and enables said means for connecting to resist movement relative to said means for receiving when said plug is inserted, whereby stable electrical connection between said electrode and said circuit is assured; and said means for connecting comprising a means to mount the assembly wherein said means to mount is co-planar with a bottom of said assembly.

2. A connective jack assembly, comprising:

means for receiving a plug in a plug insertion hole;

means for connecting said plug to a circuit when said plug is inserted;

said means for connecting includes a three-point electrical contact with an outer surface of an electrode on said plug;

said means for connecting having a shape which elastically urges said outer surface into said three-point electrical connection; and at least one of said means for receiving and said means for connecting having a shape which urges said means for connecting into an elastic snap-fit engagement with said means for receiving and enables said means for connecting to resist movement relative to said means for receiving when said plug is inserted, whereby stable electrical connection between said electrode and said circuit is assured;

said means for receiving being a housing;

a first and a second engagement projection on said housing;

said first and said second engagement projections each having a sloped surface and a second surface;

a horizontal plate on said means for connecting;

said means for connecting including a sleeve terminal;

a first and a second side plate on said sleeve terminal orthogonal said horizontal plate and positionable adjacent said housing;

a first notch on each said first and said second side plate; and said slope surfaces engaging and urging open each said first and said second side plate when said sleeve terminal is pressed onto said housing and each said second surface providing said snap-fit engagement to each respective said first notch, whereby said sleeve terminal is secured to said housing.

3. A connective jack assembly, according to claim 2, further comprising:

a first and a second spring member on said means for connecting;

said spring members cantilevered inside said housing during said elastic snap-fit engagement; and said spring members extending substantially adjacent said outer surface and coaxial said plug insertion hole for said urging of said outer surface into said three-point electrical connection.

4. A connective jack assembly, according to claim 3, further comprising:

a position groove on said housing; and said position groove engaging opposite sides of said horizontal plate after said snap-fit engagement and laterally supporting said sleeve terminal relative said plug insertion hole whereby said stable electrical connection is maintained during operation.

5. A connective jack assembly, according to claim 4, further comprising:

a first contact projection on said horizontal plate;

a second contact projection on said first spring member;

a third contact projection on said second spring member; and said first, said second, and said third contact projections projecting substantially radially inward to said plug insertion hole and permitting said three-point electrical connection to said outer surface of said electrode.

6. A connective jack assembly, according to claim 5, further comprising:

a chip terminal in said means for connecting;

a chip terminal holding groove in said housing;

said chip terminal in said chip terminal holding groove;

at least a first engagement portion of said chip terminal in restrictive contact with said chip terminal holding groove and retaining said chip terminal in said housing;

a chip leg member extending from said chip terminal engageable with said circuit; and a chip contact member on said chip terminal having a shape enabling secure elastic electrical connection from a chip electrode portion on said plug to said circuit.

7. A connective jack assembly, according to claim 6, further comprising:

a ring terminal in said means for connecting;

a ring terminal holding groove in said housing;

an engagement piece on a base portion of said ring terminal;

a slip prevention hole on said housing engagable with said engagement piece during an insertion of said ring terminal in said ring terminal holding groove;

a ring leg member extending from said ring terminal engagable with said circuit; and a ring contact member on said ring terminal having a shape enabling secure elastic electrical connection from a ring electrode portion of said plug to said circuit.

8. A connective jack assembly, comprising:

a housing member;

said housing member including a plug hole for receiving a plug;

a sleeve terminal on said housing member alignable with a circuit;

at least a first and a second leg disposed on said sleeve terminal, wherein said first and second legs are coplanar with a bottom of said assembly;

a first and a second spring piece on said sleeve terminal extendable inside said housing member and coaxial said plug hole for elastically engaging said plug;

a first protection on a plate portion of said sleeve terminal;

a second projection said first spring piece opposite said first projection;

a third projection said second spring piece opposite said first projection; and said first and said second spring pieces urging a sleeve electrode on said plug into firm contact with said first, said second, and said third projection when said plug is inserted, whereby said plug is urged into stable three-point connection with said sleeve terminal and said circuit.

9. A connective jack assembly, comprising:

a housing member;

said housing member including a plug hole for receiving a plug;

a sleeve terminal on said housing member alignable with a circuit;

a first and a second spring piece on said sleeve terminal extendable inside said housing member and coaxial said plug hole for elastically engaging said plug;

a first projection on a horizontal plate of said sleeve terminal;

a second projection on said first spring piece opposite said first projection;

a third projection on said second spring piece opposite said first projection;

said first and said second spring pieces urging a sleeve electrode on said plug into firm contact with said first, said second, and said third projection when said plug is inserted, whereby said plug is urged into stable three-point connection with said sleeve terminal and said circuit;

a position groove on said housing member opposite said plug hole;

said position groove includes a window hole; and said first and said second spring piece insertable into said housing member through said window hole during said assembly.

10. A connective jack assembly, according to claim 9, wherein said horizontal plate in said position groove and said position groove engaging opposite sides of said horizontal plate during an assembly of said first and said second spring piece in said housing member, whereby said position groove laterally supports said sleeve terminal and resists a movement of said sleeve terminal relative to said housing member during said insertion.

11. A connective jack assembly, according to claim 10, wherein:

at least one of said housing member and said sleeve terminal have a shape which urges said sleeve terminal into a elastic-engagement with said housing member during said assembly whereby said sleeve terminal resists movement of said sleeve terminal relative to said housing member during said insertion of said plug.

12. A connective jack assembly, according to claim 11, further comprising:

a first and a second engagement projection on said housing member;

a first and a second side plate on said sleeve terminal opposite said horizontal plate;

a notch on each said first and said second side plate positionable opposite said first and said second engagement projection; and said notches engaging a sloped surface on each said first and said second engagement projection during an assembly of said connective jack and engaging a flat surface upon completing said assembly whereby said snapping-engagement fixes said sleeve terminal to said housing member and resists said movement.

13. A connective jack assembly, according to claim 12, further comprising:

a chip terminal;

a chip terminal holding groove in said housing member;

said chip terminal in said chip terminal holding groove;

at least a first engagement claw on said chip terminal in restrictive contact with said chip terminal holding groove, whereby said chip terminal is retained in said housing member;

a chip leg member extending from said chip terminal engagable with said circuit; and a chip contact member on said chip terminal having a shape enabling secure elastic connection to a chip electrode of said plug during said insertion, whereby said chip contact member is urged into stable electrical connection with said chip electrode.

14. A connective jack assembly, according to claim 13, further comprising:

a ring terminal;

a ring terminal holding groove in said housing member;

said ring terminal in said ring terminal holding groove;

an engagement piece on a base portion of said ring terminal;

said housing member including a slip prevention hole formed for receiving and retaining said engagement piece during an insertion of said ring terminal into said ring terminal holding groove;

a ring leg member extending from said ring terminal engagable with said circuit; and a ring contact on said ring terminal having a shape enabling secure elastic connection to a ring electrode of said plug during said insertion, whereby said ring contact is urged into stable electrical connection with said ring electrode.

15. A connective jack, comprising:

an insulative housing having a plug insertion hole for receiving a plug during an insertion of said plug;

a sleeve terminal on said insulative housing having a shape enabling secure elastic electrical connection to a circuit;

a first and a second spring piece on said sleeve terminal extending inside said insulative housing coaxial said insertion hole;

said insulative housing having a position groove opposite said insertion hole;

said position groove includes a window hole for receiving said first and said second spring piece during an assembly of said connective jack; and said first and said second spring piece having a shape resiliently urging said plug into stable close contact with said sleeve terminal during said insertion whereby said sleeve terminal enables secure electrical connection from said plug to said circuit.

16. A connective jack, according to claim 15, further comprising:

a first, a second, and a third contact projection;

said first and said second contact projection on respective said first and said second spring piece;

an attachment plate on said sleeve terminal;

said third contact projection on said attachment plate opposite said first and said second contact projection; and said first and said second spring piece elastically urging said plug into three-point contact with said first, said second, and said third contact projection.

17. A connective jack, according to claim 16, further comprising:

a first and a second side plate on said sleeve terminal opposite said attachment plate;

a first and a second notch on respective said first and second side plate;

a first and second projection on said insulative housing opposite each respective said first and said second notch; and at least one of said first and said second notch and said first and said second projection having a shape which provides said sleeve terminal with snapping-engagement to said insulative housing during an assembly of said connective jack.

18. A sleeve terminal for a connective jack, comprising:

a metallic side;

a fixed first contact formed on said metallic side;

at least a first and a second spring piece depending from same said metallic side;

second and third contacts formed at extremities of said first and second spring pieces; and said first and second spring pieces placing urgent inward force on a plug inserted into said connective jack to resiliently capture said plug in three-point resilient contact between said first, second, and third contacts.

* * * * *